US005617817A

United States Patent [19]

Martin

[11] Patent Number: 5,617,817

[45] Date of Patent: Apr. 8, 1997

[54] FAN DRIVE WITH A FLUID-FRICTION CLUTCH

[75] Inventor: Hans Martin, Stuttgart, Germany

[73] Assignee: BEHR GmbH & Co., Stuttgart, Germany

[21] Appl. No.: 374,910

[22] Filed: Jan. 19, 1995

[30] Foreign Application Priority Data

Jan. 25, 1994 [DE] Germany ..... 44 01 979.3

[51] Int. Cl.[6] ..... F01P 7/02

[52] U.S. Cl. ..... 123/41.12

[58] Field of Search ..... 123/41.12, 41.49

[56] References Cited

U.S. PATENT DOCUMENTS

| | | | |
|---|---|---|---|
| 3,363,734 | 1/1968 | Sabat | 123/41.12 |
| 3,853,098 | 12/1974 | Ishikawa et al. | 123/41.49 |
| 3,894,521 | 7/1975 | Sakasegawa et al. | 123/41.12 |

FOREIGN PATENT DOCUMENTS

| | | |
|---|---|---|
| 352754 | 5/1922 | Germany . |
| 2349945 | 4/1974 | Germany . |
| 2360386 | 6/1974 | Germany . |
| 3322779 | 1/1985 | Germany . |
| 3345340 | 6/1985 | Germany . |

*Primary Examiner*—Noah P. Kamen
*Attorney, Agent, or Firm*—Foley & Lardner

[57] ABSTRACT

A fan drive with a fluid-friction clutch comprises an input shaft with input disk and a clutch housing. This housing is rotatably mounted on the input shaft and bears a fan driven via the input shaft by a motor vehicle engine and serves to deliver cooling air through a cooling circuit radiator and/or a refrigerant circuit condenser. To increase the fan speed, the fluid-friction clutch housing is driven through at least one freewheel by an electric motor attached to the vehicle. The driving (switching on and off) by the electric motor takes place as a function of the fan speed $n_2$ and/or as a function of the temperature of the coolant or refrigerant. A second freewheel may be arranged in the engine-side drive train. The clutch hub is extended axially by a cylindrical hub piece that accommodates, via a ball bearing, an input-shaft stub that bears the second freewheel, which is secured in a hollow hub that drives the input disk via the input shaft.

11 Claims, 2 Drawing Sheets

FAN DRIVE WITH A FLUID-FRICTION CLUTCH

BACKGROUND OF THE INVENTION

The invention relates to a fan drive with a fluid-friction clutch for motor vehicles.

A fan drive of this kind has been disclosed in DE-C 33 22 779 by the applicant. In this drive, provision is made for the fan to run at increased speed at a low engine speed. In addition, at a low engine speed, provision is made for the fan to cool the radiator and/or the upstream condenser of a motor-vehicle air-conditioning system to ensure that the heat arising can be removed by a corresponding delivery of cooling air. In the case of the known drive, the fan speed is increased using a planetary gear integrated into the fluid-friction clutch by varying the transmission ratio. However, such a drive has proven unsatisfactory.

SUMMARY OF THE INVENTION

It is therefore an object of the present invention to provide a fan drive for motor vehicles, particularly those with an air-conditioning system, in which the fan speed can be increased by simple means and with a low power in the case of a low engine speed (during idling).

This object is achieved by means of a fan drive with a fluid-friction clutch. According to the present invention, the fan drive comprises an input shaft with an input disk. A clutch housing is rotatably mounted on the input shaft and bears a fan. The fan is driven via the input shaft by an engine of a motor vehicle and serves to deliver cooling air through at least one of a radiator of a cooling circuit and a condenser of a refrigerant circuit. To increase a speed of the fan, the clutch housing of the fluid-friction clutch is driven as required via at least one freewheel by an electric motor attached to the vehicle.

According to the invention, a fan drive known per se with a known fluid-friction clutch has connected to it via a freewheel an electric motor mounted in the vehicle. Connection is performed as a function of a suitable parameter, for example the fan speed or the coolant or refrigerant temperature. When this threshold value is reached, the electric motor cuts in automatically and overruns the drive from the engine by means of the freewheel between the electric motor and the clutch housing. The electric motor is fed by way of the battery network of the vehicle and, via a V-belt drive, provides drive directly to the output side of the clutch, i.e. to the fan. This allows the fan to be brought to the desired speed and held at this speed with a relatively small amount of additional power. If the engine speed increases again, the electric motor can be switched off and the output of the electric motor is overrun by virtue of the freewheel.

Advantageous developments of the invention emerge from other disclosed features. Thus, it is possible, for example, to provide a further freewheel in the drive train between the engine and the input disk of the clutch. This second freewheel can be arranged either within the clutch or outside the clutch. The first freewheel can furthermore be mounted either on the output shaft of the electric motor, i.e. in the first V-belt pulley, or on the hub of the second V-belt pulley and within a hollow hub of the clutch. The freewheel itself is a commercially available part which is of relatively small size and low cost, making it possible to achieve an increase in the speed of the fan drive at minimum outlay in terms of cost and construction in the case of the need concerned. The electric motor can, for example, be mounted on the engine block.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred exemplary embodiments of the invention. Together with the general description given above and the detailed description of the preferred embodiments given below, the drawings serve to explain the principles of the invention.

Exemplary embodiments of the invention are depicted in the drawings and described in greater detail below. In the drawings, all the figures show a fluid- friction clutch with an electric-motor auxiliary drive and different arrangements of the freewheel or freewheels. Thus.

DETAILED DESCRIPTION OF THE PREFERRED EMBODIMENTS

Figure 1:
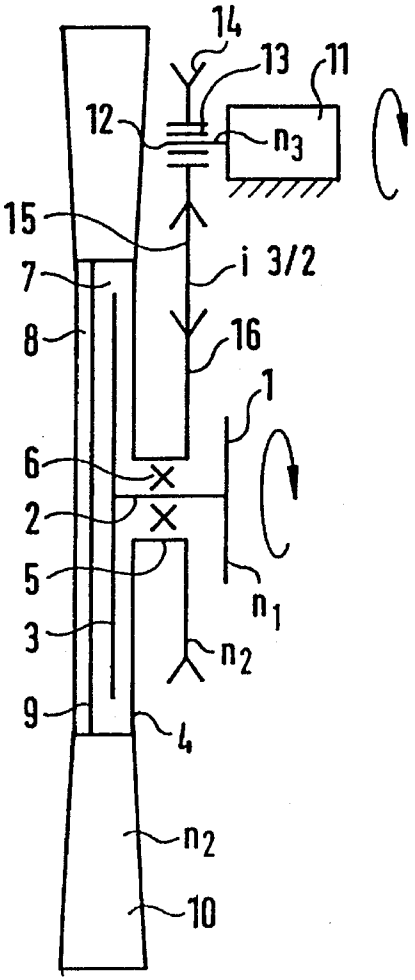
FIG. 1 shows the arrangement of the freewheel between the drive shaft of the electric motor and the hub of the V-belt pulley.

FIG. 1 shows, in schematic representation, a fluid-friction clutch known per se which, on the input side, comprises an input flange 1, an input shaft 2 and an input disk 3 secured thereon. A clutch housing 4 is rotatably mounted on the input shaft 2 via a hub 5 by means of a ball bearing 6. The housing 4 comprises, as is customary, a working chamber 7 and a reservoir chamber. These chambers are partitioned off from one another by a dividing wall 9 but are connected to one another in terms of flow by openings or valves (not shown). The torque from the input disk 3 is transmitted by the fluid friction of a viscous medium to the housing 4, which bears a fan ring 10. This fan 10 delivers cooling air through a water-filled radiator (not shown) and a condenser, arranged ahead of the latter, of an air-conditioning system of a motor vehicle. The driving of the clutch by way of the input flange 1 is accomplished by means of the internal combustion engine of the vehicle.

According to the invention, an electric motor 11, which is arranged in the region of the clutch, is attached to the vehicle or body and has an output shaft 12. By way of a freewheel 13 secured on the output shaft 12, the electric motor 11 drives, via a first V-belt pulley 14 and a V-belt drive 15, a second V-belt pulley 16 which is attached to the clutch housing 4 or its hub 5. Between the two V-belt pulleys 14 and 16, there is a transmission ratio $i_{3/2}$. The freewheel 13 arranged between the output shaft 12 of the electric motor 11 and the hub of the first V-belt pulley 14 is a commercially available "sleeve-type" freewheel, as obtainable, for example, from the firm INA, Herzogenaurach.

This freewheel 13 is secured on the drive shaft 12 or in the hub of the V-belt pulley 14 in such a way that drive (or power) is transmitted from the electric motor 11 to the clutch housing 4 only when the speed $n_3$ of the output shaft 12 is greater than that of the V-belt pulley 14. Thus, torque can be transmitted to the V-belt drive 15 and the fan 10 can be additionally driven by the electric motor 11. This drive by the electric motor 11 switches on automatically when either the fan 10 falls below a certain minimum speed (and hence no longer delivers sufficient cooling air) or when the temperature of the refrigerant (or coolant) in the above-mentioned condenser of the air-conditioning system of the vehicle exceeds a certain temperature, i.e. when the air-conditioning system is no longer providing sufficient cooling to cool the vehicle interior. This situation occurs especially when the vehicle is idling and the external temperatures are correspondingly high. The automatically switched-on electric motor then acts more or less as an additional drive or booster to boost the drive provided by the internal combustion engine. By virtue of the transmission ratio $i_{3/2}$, i.e. the ratio of the speeds $n_3$ of the electric motor and $n_2$ of the fan by means of the V-belt drive 14, 15, 16, it is possible to use an optimum electric motor as regards speed, torque and weight.

Figure 2:
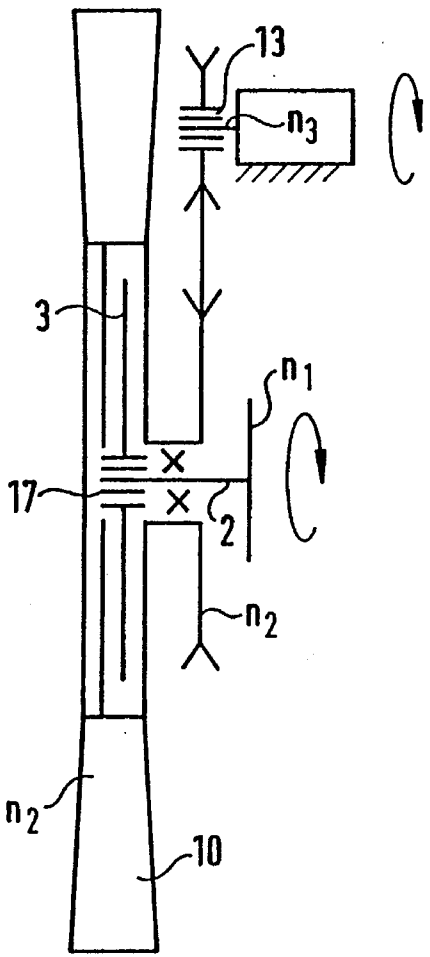
FIG. 2 shows the arrangement of a first freewheel as in FIG. 1 but with a second freewheel between the drive shaft and the input disk.

FIG. 2 shows a further variant. Here, identical reference numerals apply to identical parts and, for this reason, not all of them are entered in the drawing. In addition to the freewheel 13, a second freewheel 17 is provided between the input shaft 2 of the clutch and the input disk 3. When the speed of the input disk 3 or speed of the fan $n_2$ rises above the driving speed $n_1$ of the engine, the clutch housing 4 overruns the input shaft 2 and torque is no longer transmitted. The input disk 3 is merely taken along by the housing.

Figure 3:
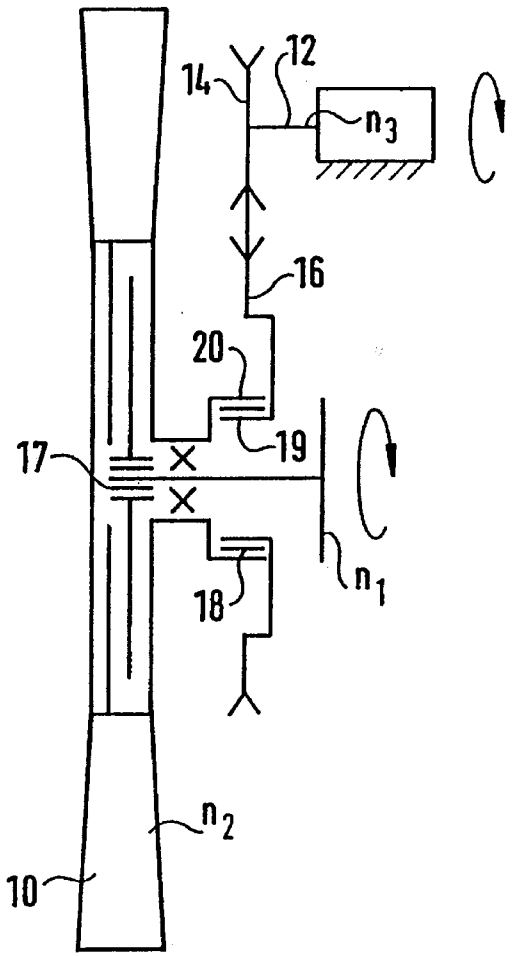
FIG. 3 shows the drive with a first freewheel between the clutch-side V-belt pulley and the hub of the clutch and a second freewheel between the drive shaft and the input disk of the clutch.

A further exemplary embodiment is depicted in FIG. 3, where the freewheel between the output shaft 12 of the electric motor 11 and the first V-belt pulley 14 is omitted and is instead arranged as freewheel 18 on a hub 19 of the second V-belt pulley 16 and drives the clutch housing 4 via a clutch hub 20. The freewheel 17 is retained as in the exemplary embodiment in FIG. 2. Thus, as long as the V-belt pulley 16 does not rotate faster than the clutch housing, rotating at speed $n_2$, the drive is transmitted to the clutch housing via the freewheel 17 with the driving speed $n_1$.

Figure 4:
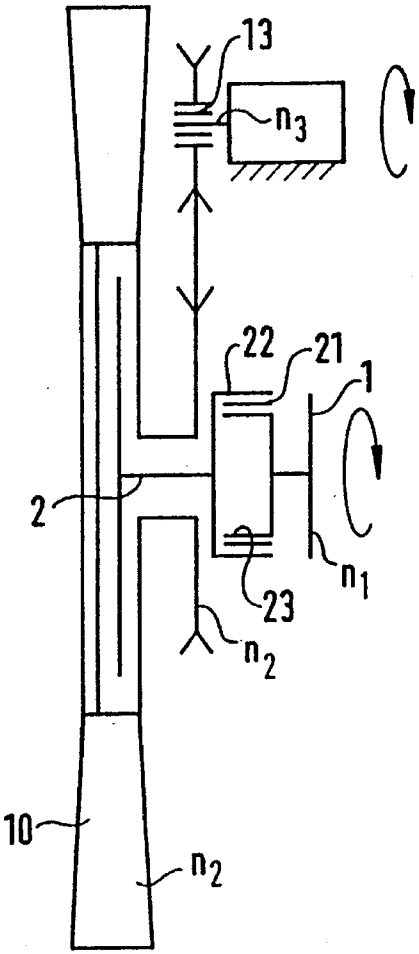
FIG. 4 shows a first freewheel as in FIGS. 1 and 2 and a second freewheel between the input flange and the input shaft of the clutch.

A further variant is shown by FIG. 4, where—as in FIGS. 1 and 2—a first freewheel 13 is again provided between the electric motor and the first V-belt pulley. The freewheel 21 corresponding to the exemplary embodiments in accordance with FIGS. 2 and 3 is here moved outwards out of the clutch housing. The freewheel 21, which is driven on an inner drum 23 by the flange 1 belonging to the engine and is, on the other hand, secured in an outer drum 22 connected to the input shaft 2. The manner in which the drive 1 from the engine to the input disk 3 operates corresponds to the exemplary embodiment in accordance with FIG. 3. However, the division of the drive train 1, 2 by the freewheel is arranged outside the clutch, i.e. no modifications need be made within the clutch.

Figure 5:
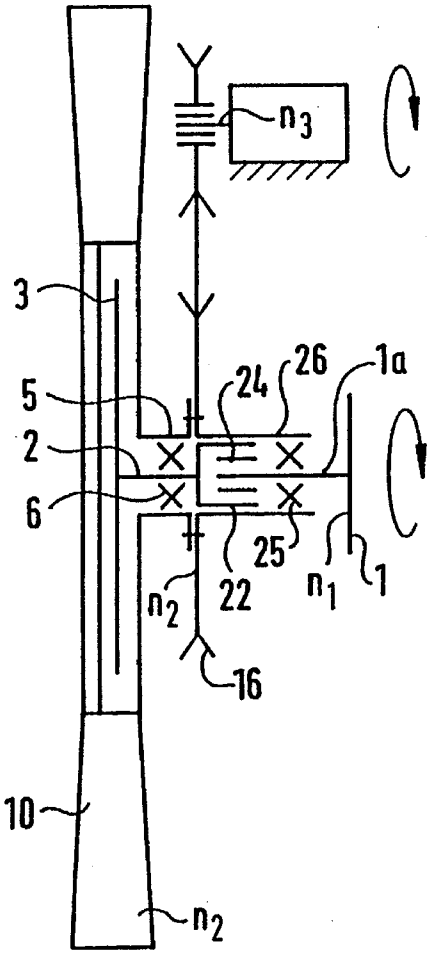
FIG. 5 shows a first freewheel as in FIGS. 1 and 2 and 4 and a second freewheel between the input flange and the input shaft, in principle as in FIG. 4

A final exemplary embodiment is depicted in FIG. 5, which corresponds in terms of functioning to the exemplary embodiment in accordance with FIG. 4. The freewheel in the engine-side drive train is of different construction. Specifically clutch hub 5 is extended axially by a cylindrical hub piece 26 which accommodates an additional bearing 25, in which the input-shaft stub 1*a* from the engine is supported. At the other end from the input flange 1, the stub carries a freewheel 24, which is secured in a hollow hub 22 of the input shaft 2. The drive from the engine is thus transmitted from the input-shaft stub 1*a*, via the freewheel 24, to the input shaft 2 and the input disk 3. The V-belt pulley 16 is secured on the clutch, on the hub 5.

Figure 6:
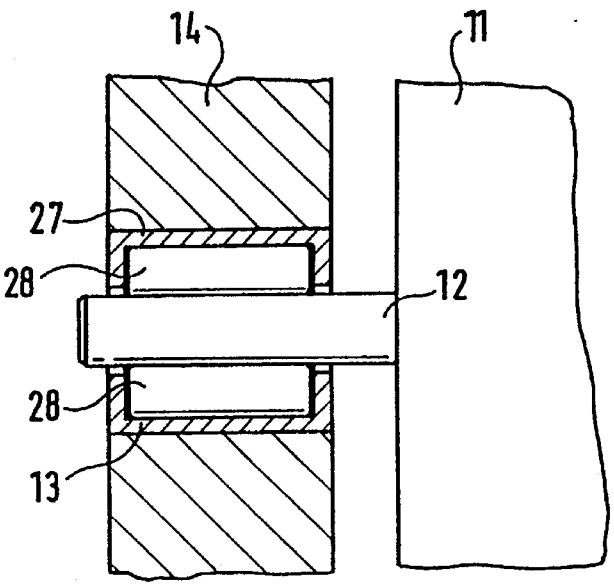
FIG. 6 shows a freewheel in detail.

FIG. 6 shows a detailed representation of the freewheel 13, as provided in the exemplary embodiments in accordance with FIGS. 1, 2, 4 and 5. As already mentioned, the freewheel concerned here is a "sleeve-type" freewheel, which is commercially available and is sold, for example, by the company INA, Herzogenaurach. A sleeve 27 accommodates, in a manner distributed around the circumference, needle-shaped rolling or wedging elements 28 which are slipped onto the output shaft 12 of the electric motor. The sleeve 27 is pressed into a corresponding hole in the V-belt pulley 14. Power is transmitted from the shaft 12 to the V-belt pulley 14 when the shaft 12 attempts to rotate faster than the V-belt pulley 14, in which case the wedging elements 28 lock up. Sleeve-type freewheels of this kind are also provided for the other cases, where they bear the reference numerals 17, 18, 21 and 24.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A fan drive for a motor vehicle comprising:

a) a temperature controlled fluid-friction clutch having an input shaft with an input disk, and a clutch housing rotatably mounted on the input shaft and bearing a fan, the fan being adapted to be driven via the input shaft by an engine of the motor vehicle and adapted to deliver cooling air through at least one of a radiator of a cooling circuit and a condenser of a refrigerant circuit;

b) an electric motor drivingly coupled to the clutch housing via a first freewheel; and c) a second freewheel coupled to the input disk and the engine, wherein the engine drives the input disk through the second freewheel, wherein, to increase a speed of the fan, the clutch housing of the fluid-friction clutch is driven by the electric motor via the first freewheel.

2. The fan drive as claimed in claim 1, wherein driving by the electric motor is selectively switched on and off as a function of at least one of the fan speed $n_2$ and a temperature of refrigerant.

3. The fan drive as claimed in claim 2, wherein power is transmitted from the electric motor to the housing by way of a V-belt drive.

4. The fan drive as claimed in claim 2, wherein the first freewheel is coupled to an output shaft of the electric motor and the clutch housing.

5. The fan drive as claimed in claim 1, wherein power is transmitted from the electric motor to the housing by way of a V-belt drive.

6. The fan drive as claimed in claim 5, wherein the first freewheel is coupled to an output shaft of the electric motor and the V-belt drive.

7. The fan drive as claimed in claim 1, wherein the first freewheel is coupled to an output shaft of the electric motor and the clutch housing.

8. The fan drive as claimed in claim 7, wherein the electric motor output shaft is coupled to a V-belt pulley via the first freewheel.

9. The fan drive as claimed in claim 7, wherein the electric motor is operatively coupled to a V-belt pulley having a hub, wherein the housing has a bearing seat, and wherein the first freewheel is coupled to the pulley hub and the bearing seat.

10. The fan drive as claimed in claim 1, wherein the input shaft has an outer drum and the engine has an input flange having an inner drum, wherein the outer and inner drums are coupled via the second freewheel.

11. The fan drive as claimed in claim 1, wherein the clutch housing has an axially extending clutch hub connected to an axially extending cylindrical hub piece, wherein the input shaft is journaled for rotation using a ball bearing to the clutch hub and has a hollow hub positioned inside the hub piece, wherein the engine has an input-shaft stub coupled to the hollow hub via the second freewheel.

* * * * *